US009301581B1

(12) United States Patent
Su et al.

(10) Patent No.: US 9,301,581 B1
(45) Date of Patent: Apr. 5, 2016

(54) AUTOMATIC UMBRELLA WITH CANOPY ROTATING FUNCTION

(71) Applicants: Ping-Tung Su, Hsin-Chu (TW); Shih-Shin Kuo, Hsinchu (TW)

(72) Inventors: Ping-Tung Su, Hsin-Chu (TW); Shih-Shin Kuo, Hsinchu (TW)

( * ) Notice: Subject to any disclaimer, the term of this patent is extended or adjusted under 35 U.S.C. 154(b) by 0 days.

(21) Appl. No.: 14/698,208

(22) Filed: Apr. 28, 2015

(51) Int. Cl.

| | |
|---|---|
| ***A45B 25/08*** | (2006.01) |
| ***A45B 25/10*** | (2006.01) |
| ***A45B 25/22*** | (2006.01) |
| ***A45B 25/02*** | (2006.01) |

(52) U.S. Cl.
CPC ..... *A45B 25/02* (2013.01); *A45B 25/08* (2013.01); *A45B 25/10* (2013.01); *A45B 25/22* (2013.01); *A45B 2025/105* (2013.01)

(58) Field of Classification Search
CPC ..... A45B 25/06; A45B 25/10; A45B 25/22; A45B 2025/105; A45B 25/08
See application file for complete search history.

(56) References Cited

U.S. PATENT DOCUMENTS

| | | | | | |
|---|---|---|---|---|---|
| 4,962,780 | A * | 10/1990 | Engdahl | A45B 25/18 | 135/16 |
| 4,998,551 | A * | 3/1991 | DeSarno | A45B 25/22 | 135/15.1 |
| 5,020,557 | A * | 6/1991 | Apple | A45B 23/00 | 135/15.1 |
| 6,314,976 | B1 * | 11/2001 | Clarke | A45B 23/00 | 135/28 |
| 6,889,699 | B2 * | 5/2005 | Clarke | A45B 23/00 | 135/20.3 |
| 6,948,506 | B2 * | 9/2005 | Wang | A45B 25/10 | 135/15.1 |
| 7,293,573 | B2 * | 11/2007 | Clarke | A45B 23/00 | 135/16 |
| 7,318,444 | B2 * | 1/2008 | Clarke | A45B 25/06 | 135/28 |
| 8,087,420 | B1 * | 1/2012 | Lukacsy | A45B 23/00 | 135/20.3 |
| 8,096,310 | B2 * | 1/2012 | Clarke | A45B 25/02 | 135/16 |
| 2002/0088483 | A1 * | 7/2002 | Clarke | A45B 23/00 | 135/15.1 |
| 2004/0206382 | A1 * | 10/2004 | Clarke | A45B 25/06 | 135/28 |
| 2004/0206383 | A1 * | 10/2004 | Clarke | A45B 25/02 | 135/41 |
| 2004/0226589 | A1 * | 11/2004 | Wang | A45B 25/10 | 135/19 |
| 2004/0255994 | A1 * | 12/2004 | Clarke | A45B 23/00 | 135/39 |
| 2006/0278261 | A1 * | 12/2006 | Marcelli | A45B 25/18 | 135/98 |
| 2007/0062565 | A1 * | 3/2007 | Clarke | A45B 25/02 | 135/16 |
| 2008/0202570 | A1 * | 8/2008 | Clarke | A45B 25/06 | 135/28 |

* cited by examiner

*Primary Examiner* — Robert Canfield
(74) *Attorney, Agent, or Firm* — C. G. Mersereau; Nikolai & Mersereau, P.A.

(57) ABSTRACT

An umbrella with a canopy rotating function comprises a central shaft, an upper nest assembly, a lower nest assembly, a canopy unit. The upper nest assembly comprises an upper nest body, a fastener and a movable upper nest. The lower nest assembly comprises a pulley seat, a lower nest body and a movable lower nest. Thus, in an opened state, the upper nest body and the lower nest body are connected and positioned, and the canopy unit can link with the movable upper nest and the movable lower nest, so that the movable lower nest and the movable upper nest synchronously rotate relatively to the central shaft.

10 Claims, 6 Drawing Sheets

AUTOMATIC UMBRELLA WITH CANOPY ROTATING FUNCTION

BACKGROUND OF THE INVENTION (1) Field of the Invention

The invention relates to an umbrella, and more particularly to an umbrella having a canopy, which can be rotated when the umbrella is opened, and the umbrella has the function of withstanding the wind and resistance.

(2) Description of the Prior Art

In the daily life, an umbrella is an essential product for the user to shield the rain in the rainy day and shade the sunlight in the sunny day. When an ordinary umbrella is used in a rainy and windy day, especially in the heavily windy weather, the umbrella tends to be broken by the strong wind, which brings the relatively large wind resistance to the umbrella, so that the ordinary umbrella encounters the deformation and damage, or a central shaft is distorted, or even the lifetime of the umbrella is shortened. On the other hand, in the normal state where no strong wind blows, the umbrella used by the user sometimes touches an object or the like. Because the canopy and the central shaft cannot be rotated relatively to each other, the central shaft tends to be distorted or damaged due to the touch with the object. If the central shaft touches a person, the danger of stabbing the pedestrian tends to occur. In order to solve the above-mentioned problem, an umbrella having a rotatable canopy unit is published in Taiwan. Such the umbrella having the rotatable canopy unit has a rotatable upper umbrella nest, which comprises an upper nest base and a movable upper nest. The movable upper nest and the upper nest base are rotatably connected to each other. The upper nest base and the central shaft of the umbrella are fixedly connected to each other. When such the umbrella with the upper umbrella nest is used by the user and encounters the strong wind or touches other objects, the canopy may be rotated about the central shaft of the umbrella. Thus, it is possible to prevent the umbrella from hurting people or objects, or to prevent the central shaft of the umbrella from being distorted. Although the umbrella using this rotatable upper umbrella nest can effectively prevent the umbrella from hurting people or objects, or prevent the central shaft of the umbrella from being distorted, the structure of the rotatable upper umbrella nest cannot be directly applied to the automatic umbrella because a drawstring is disposed between an upper nest and a lower nest of the automatic umbrella, and the conventional lower nest is integrally rotated. So, when the lower nest is integrally rotated, the drawstring between the upper nest and the lower nest is tied and the rotation is stopped, as shown in FIG. 9. Thus, it is an important problem to be solved in the industry to improve the above-mentioned drawbacks effectively.

In view of the drawbacks and inconvenience caused by the conventional umbrella, the present inventor has paid attention to the research and development according to the professional knowledge, and thus developed this umbrella with a canopy rotating function.

SUMMARY OF THE INVENTION

The invention provides an umbrella with a canopy rotating function. The umbrella comprises a central shaft, an upper nest assembly, a lower nest assembly and a canopy unit. The central shaft is a hollow structure and has an axis extending in a longitudinal direction. The upper nest assembly is pivotally mounted on a top end of the central shaft, and comprises an upper nest body, a fastener and a movable upper nest. The upper nest body is hollow tubular and fit with and pivotally connected to the central shaft. Two ends of the upper nest body have a first pivot portion and a first engagement portion, respectively. The fastener is combined with the upper nest body. Two ends of the fastener have a second pivot portion and a projection, respectively. The second pivot portion and the first pivot portion are correspondingly combined with each other. A first embedding portion is disposed between the projection and the first pivot portion. The movable upper nest has a second embedding portion correspondingly rotatably fitting with the first embedding portion, so that the movable upper nest rotates about the axis and relatively to the central shaft. The lower nest assembly is movably disposed on the central shaft, and comprises a pulley seat, a lower nest body and a movable lower nest. The pulley seat is hollow tubular and has a fitting portion. Two ends of the pulley seat have a second engagement portion correspondingly engaging with the first engagement portion, and a first connection portion, respectively. The lower nest body is connected to the pulley seat, and has a second connection portion correspondingly combined with the first connection portion, and the movable lower nest is rotatably fit with the fitting portion, so that the movable lower nest and the movable upper nest synchronously rotate about the axis and relatively to the central shaft. The canopy unit has a plurality of ribs connected between the movable upper nest and the movable lower nest, and a canopy covering over the ribs. In an opened state, the canopy unit links with the movable upper nest and movable lower nest, so that the movable lower nest and the movable upper nest synchronously rotate relatively to the central shaft.

In the umbrella with the canopy rotating function according to the invention, a top edge of the lower nest body has a positioning portion, the movable lower nest has a plurality of positioning holes at positions corresponding to the positioning portion in an equally spaced manner, and when the movable lower nest is rotated, the positioning portion can resiliently and projectingly extend to push against the positioning holes to position the movable lower nest.

In the umbrella with the canopy rotating function according to the invention, the positioning portion comprises a slot, a resilient member disposed in the slot, and a positioning ball, which is disposed on a top edge of the resilient member and can push against the positioning holes.

In the umbrella with the canopy rotating function according to the invention, an external profile of the central shaft has an octagonal shape, a concave shape, a convex shape or a geometric shape.

In the umbrella with the canopy rotating function according to the invention, internal profiles of the lower nest body and the upper nest body have structures and shapes corresponding to a structure and a shape of the central shaft, and both the lower nest body and the upper nest body and the central shaft form a positioning force for clamping each other, so that the lower nest body and the upper nest body are not rotatable.

In the umbrella with the canopy rotating function according to the invention, the second embedding portion is a projecting ring, and the first embedding portion is an annular groove, wherein the projecting ring and the annular groove are rotatable and embedded with each other, so that the movable upper nest rotates about the axis and relatively to the central shaft.

In the umbrella with the canopy rotating function according to the invention, the first engagement portion and the second engagement portion make the upper nest body and the lower nest body be combined and positioned with each other to prevent the lower nest body from arbitrarily rotating using an engagement structure in the opened state.

In the umbrella with the canopy rotating function according to the invention, the first connection portion and the second connection portion are combined with each other using a thread structure or an engagement structure.

In the umbrella with the canopy rotating function according to the invention, the upper nest body has a sleeve fitting with the central shaft.

In the umbrella with the canopy rotating function according to the invention, the movable lower nest has a collar portion corresponding to the fitting portion to make the movable lower nest be rotatably fit with the fitting portion, so that the movable lower nest rotates about the axis and relatively to the central shaft.

Thus, in the umbrella with a canopy rotating function according to the invention, the first engagement portion and the second engagement portion are connected and positioned with each other, so that the upper nest body and the lower nest body are not rotatable, or the internal profiles of the upper nest body and the lower nest body and the external profile of the central shaft have the corresponding structures and shapes to form a positioning force clamping each other, and the upper nest body and the lower nest body cannot be rotated. The canopy unit links with the movable upper nest and the movable lower nest, so that the movable lower nest and the movable upper nest synchronously rotate relatively to the central shaft. Thus, the drawbacks and problems that the drawstring is tied and the rotation is stopped can be effectively improved.

DETAILED DESCRIPTION OF THE PREFERRED EMBODIMENTS

The invention discloses an umbrella having the opening and closing principles by pushing a button, which can be easily understood by those skilled in the art. So, detailed descriptions thereof will be omitted from the following description. Meanwhile, the corresponding drawings express the schematic structures associated with the characteristics of the invention, and are not fully depicted according to the actual size.

Figure 1:
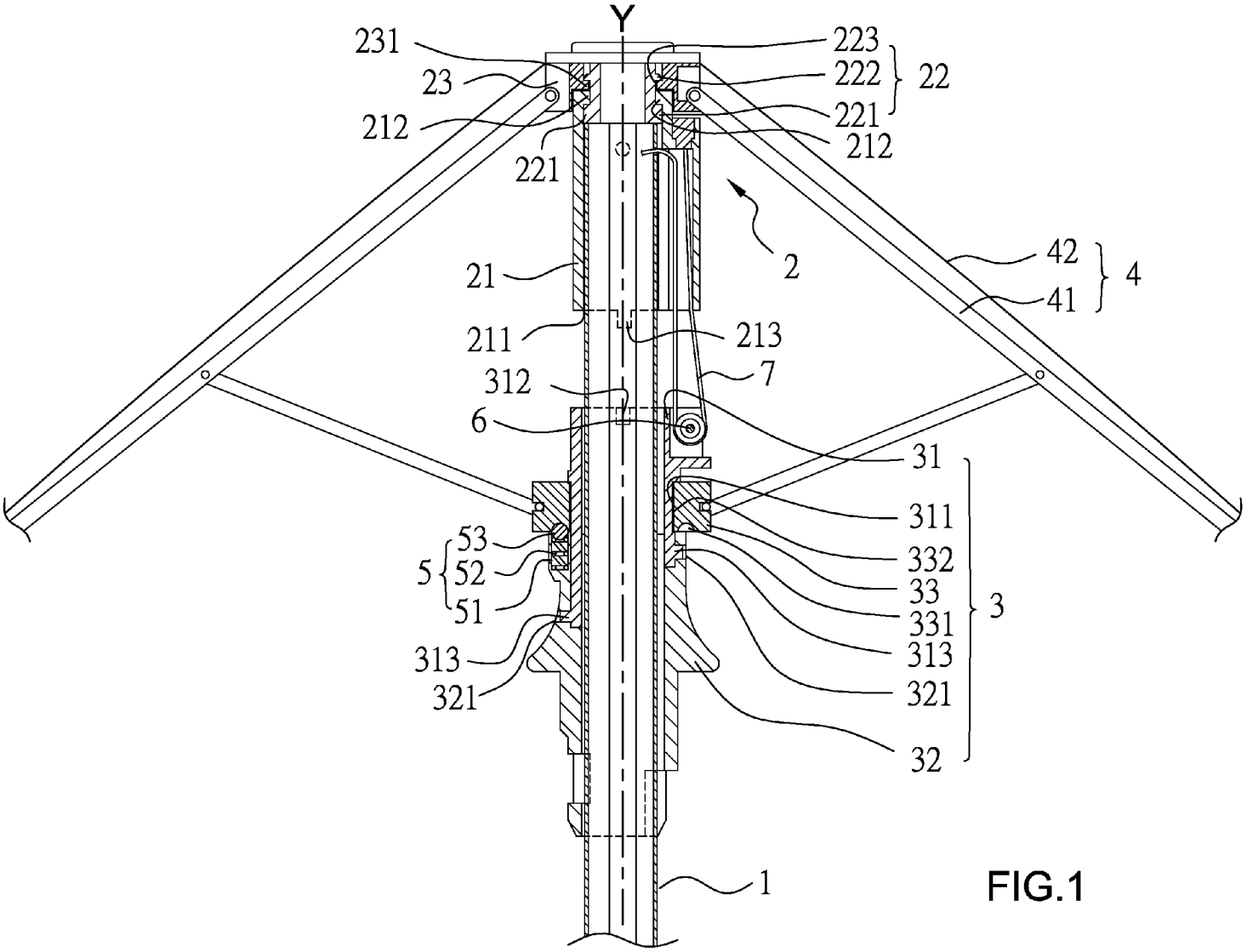
FIG. 1 is a schematic cross-sectional view showing a half opened state of the invention.

Referring to FIG. 1, a preferred embodiment of the invention comprises a central shaft 1, an upper nest assembly 2, a lower nest assembly 3 and a canopy unit 4.

Figure 3:
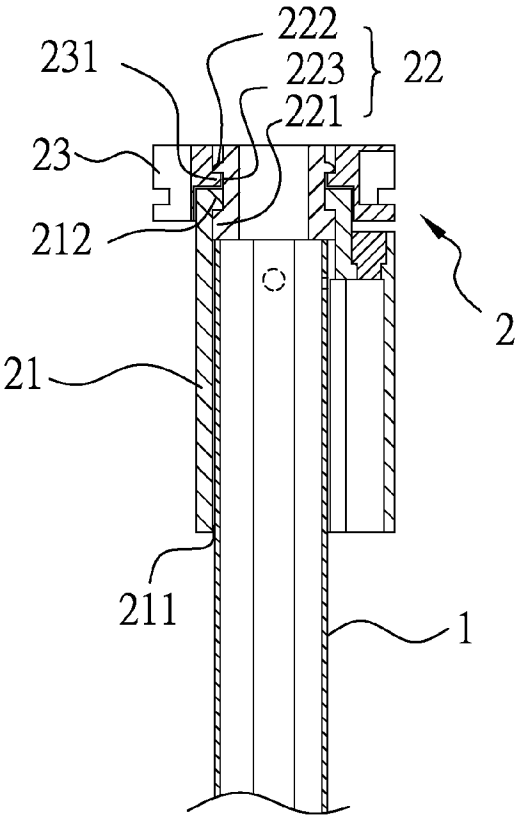
FIG. 3 is a schematic cross-sectional view showing the upper nest assembly of the invention.
Figure 2:
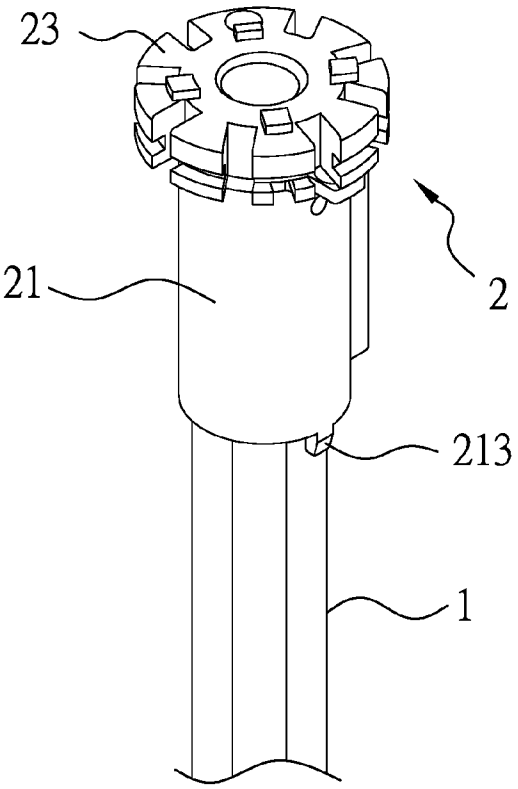
FIG. 2 is a pictorial view showing an upper nest assembly of the invention.
Figure 5:
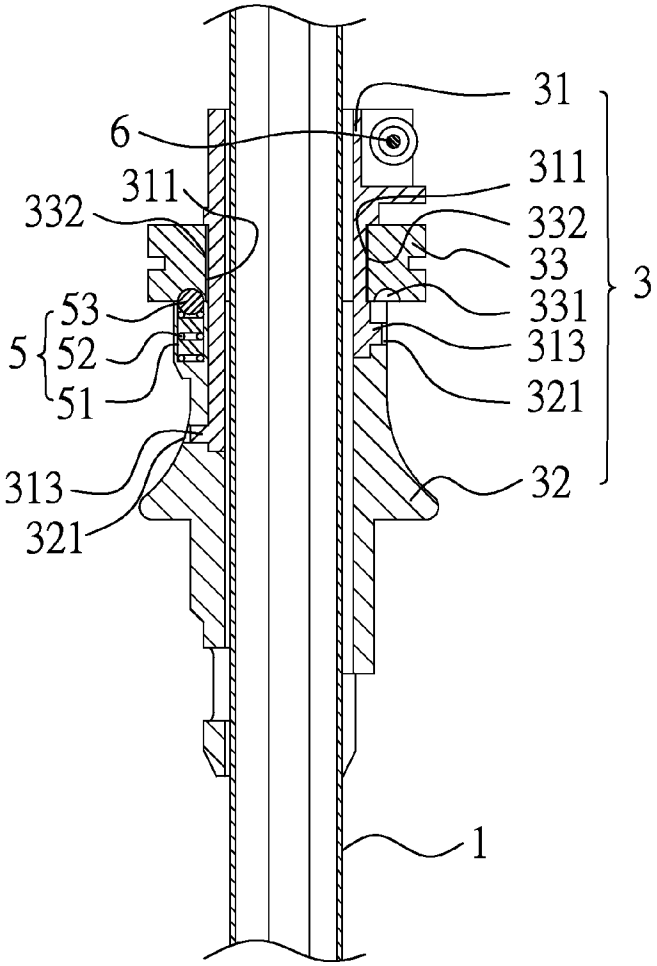
FIG. 5 is a schematic cross-sectional view showing the lower nest assembly of the invention.
Figure 4:
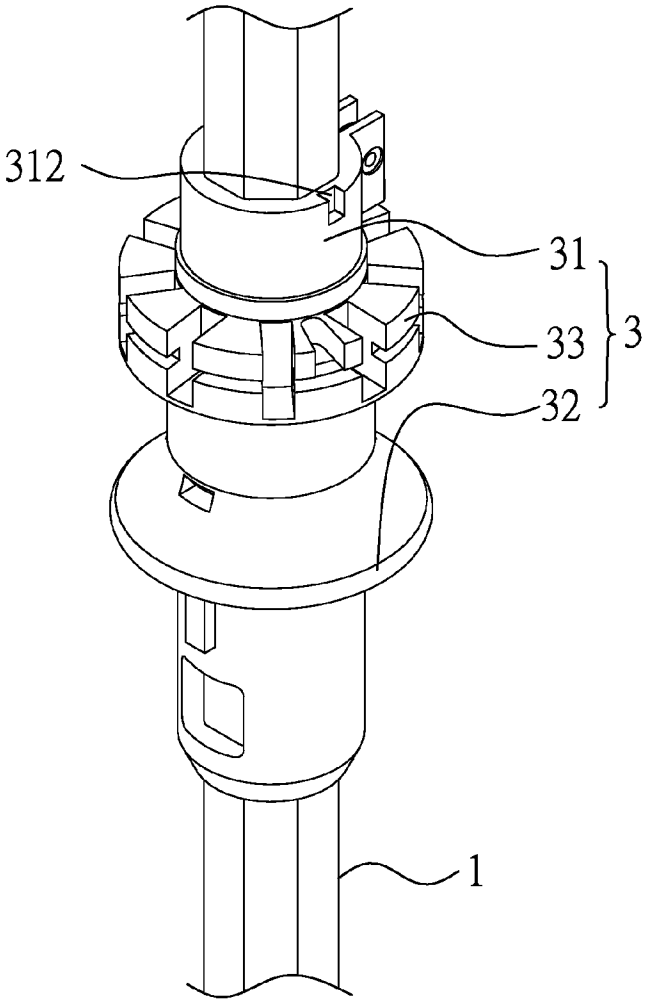
FIG. 4 is a pictorial view showing a lower nest assembly of the invention.
Figure 7:
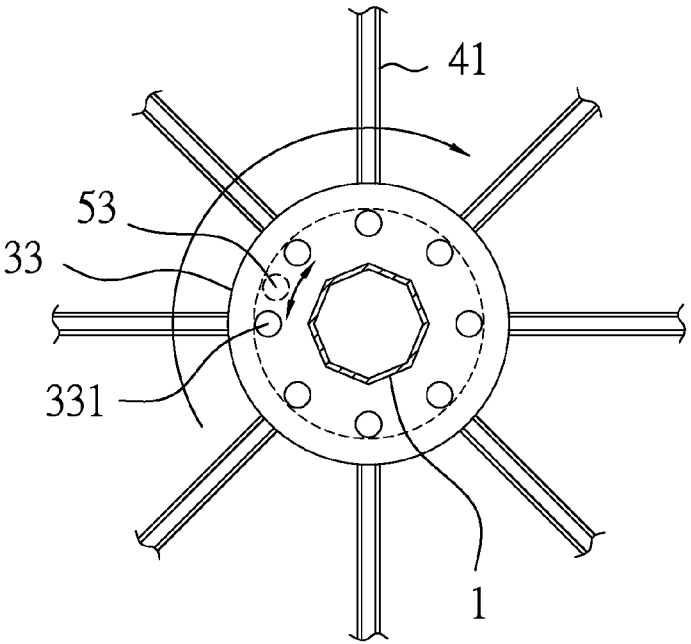
FIG. 7 is a schematic view showing a used state of the positioning portion of the invention.

Referring to FIGS. 1 to 3, the central shaft 1 of this embodiment is a hollow structure, and has an axis Y extending in a longitudinal direction. The upper nest assembly 2 pivotally mounted on a top end of the central shaft 1 comprises an upper nest body 21, a fastener 22 and a movable upper nest 23. The upper nest body 21 is hollow tubular and fit with and fixedly connected to the central shaft 1, and has a sleeve 211 fitting with the central shaft 1. Two ends of the upper nest body 21 have a first pivot portion 212 and a first engagement portion 213, respectively. The fastener 22 is combined with the upper nest body 21. Two ends of the fastener 22 have a second pivot portion 221 and a projection 222, respectively. The second pivot portion 221 is correspondingly combined with the first pivot portion 212, and a first embedding portion 223 is disposed between the projection 222 and the first pivot portion 212 along the axis Y. In this embodiment, the first embedding portion 223 is an annular groove, and the movable upper nest 23 has a second embedding portion 231 rotatably fitting with the first embedding portion 223. In this embodiment, the second embedding portion 231 is a projecting ring. The projecting ring and the annular groove are rotatable and embedded with each other, so that the movable upper nest 23 is rotated about the axis Y and relatively to the central shaft 1.

Referring to FIGS. 1 to 5, the lower nest assembly 3 of this embodiment is movably disposed on the central shaft 1 and comprises a pulley seat 31, a lower nest body 32 and a movable lower nest 33. One side of the pulley seat 31 has a pulley 6, which has a drawstring 7 connected to the upper nest body 21. The pulley seat 31 is hollow tubular and has a fitting portion 311 along the axis Y. Two ends of the pulley seat 31 have a second engagement portion 312, correspondingly engaging with the first engagement portion 213, and a first connection portion 313, respectively. The lower nest body 32 is connected to the pulley seat 31, and has a second connection portion 321 correspondingly combined with the first connection portion 313. The movable lower nest 33 has a collar portion 332 corresponding to the fitting portion 311 to make the movable lower nest 33 be rotatably fit with the fitting portion 311, so that the movable lower nest 33 is rotated about the axis Y and relatively to the central shaft 1. The canopy unit 4 has a plurality of ribs 41 connected between the movable upper nest 23 and the movable lower nest 33, and a canopy 42 covering over the ribs 41. Thus, in an opened state, the upper nest body 21 and the lower nest body 32 are not rotatable by the connecting and positioning between the first engagement portion 213 and the second engagement portion 312, and the canopy unit 4 may link with the movable upper nest 23 and the movable lower nest 33, so that the movable lower nest 33 and the movable upper nest 23 synchronously rotate relatively to the central shaft 1.

Referring to FIGS. 7 and 1 to 5, a top edge of the lower nest body 32 of this embodiment has a positioning portion 5, and the movable lower nest 33 has a plurality of positioning holes 331 at positions corresponding to the positioning portion 5 in an equally spaced manner. The positioning portion 5 comprises a slot 51, a resilient member 52 disposed in the slot 51, and a positioning ball 53, which can be disposed on the top edge of the resilient member 52 and can push against the positioning holes 331. When the movable lower nest 33 is rotated, the positioning ball 53 of the positioning portion 5 can resiliently and projectingly extend to push against the positioning holes 331 and position the movable lower nest 33.

It is worth mentioning that an external profile of the central shaft 1 of this embodiment is octagonal, but the invention is not restricted thereto. The internal profiles of the lower nest body 32 and the upper nest body 21 have structures and shapes corresponding to a structure and a shape of the central shaft 1, which are also octagonal. Because they have the angled structure and shape, the internal profiles of both the lower nest body 32 and the upper nest body 21 and the external profile of the central shaft form a positioning force for clamping each other, so that the lower nest body 32 and the upper nest body 21 are not rotatable with the movable upper nest 23 and the movable lower nest 33. Of course, in addition to the octagonal shape, the central shaft may have the concave shape, the convex shape or any geometric shape. The internal profiles of the lower nest body 32 and the upper nest body 21 may be the concave, convex or geometric shape. The main purpose is to form the positioning force for clamping the lower nest body and the upper nest body with the central shaft.

Figure 6:
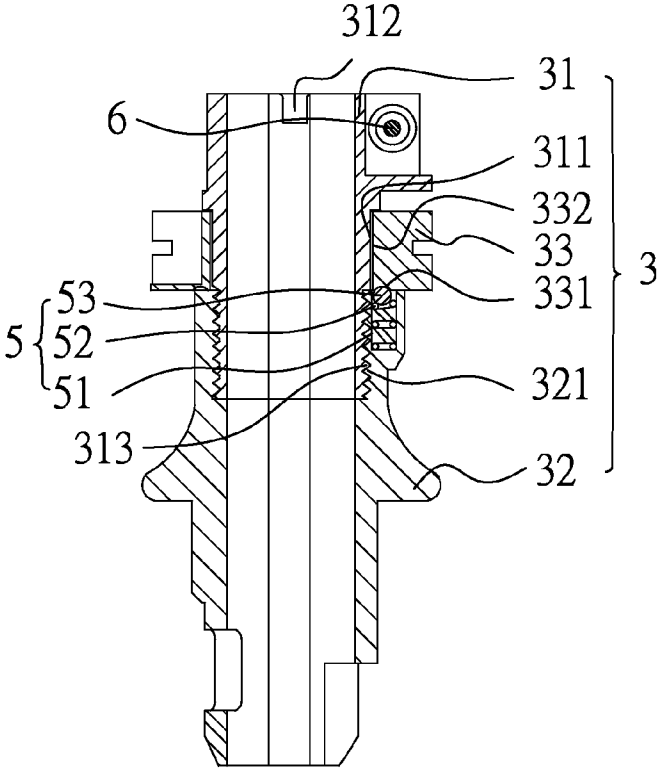
FIG. 6 is a schematic view showing another combination of the pulley seat and the lower nest body of the invention.

In addition, the first engagement portion 213 engages with the second engagement portion 312, wherein the combined structure and shape are not particularly restricted. In this embodiment, the first engagement portion 213 and the second engagement portion 312 make the upper nest body 21 and the lower nest body 32 be combined and positioned with each other. The engagement between the first and second engagement portions 213, 312 effectively avoids the lower nest body 32 from shaking relative to the main shaft 1 due to gaps between the lower nest body 32 and the central shaft 1. The engagement between the first and second engagement portions 213, 312 also effectively avoids the lower nest body 32 from rotating relative to the central shaft 1 if a large torque is applied to the lower nest body 32. The first connection portion 313 and the second connection portion 321 are combined with each other with the structure and shape, which are not particularly restricted. For example, the first connection portion 313 and the second connection portion 321 are combined with each other using an engagement structure, or a thread structure, as shown in FIG. 6.

Figure 8:
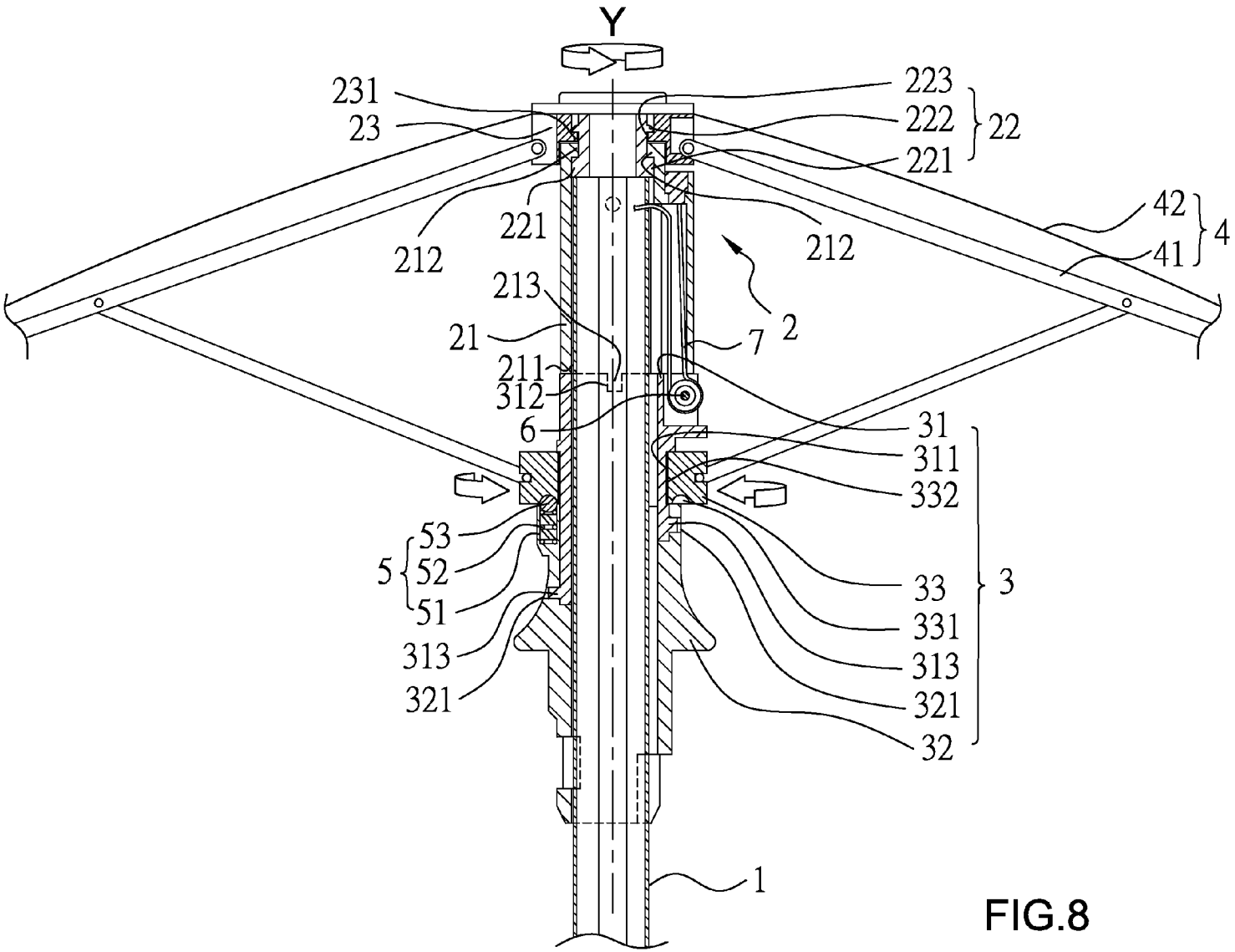
FIG. 8 is a schematic view showing an opened used state of the invention.
Figure 9:
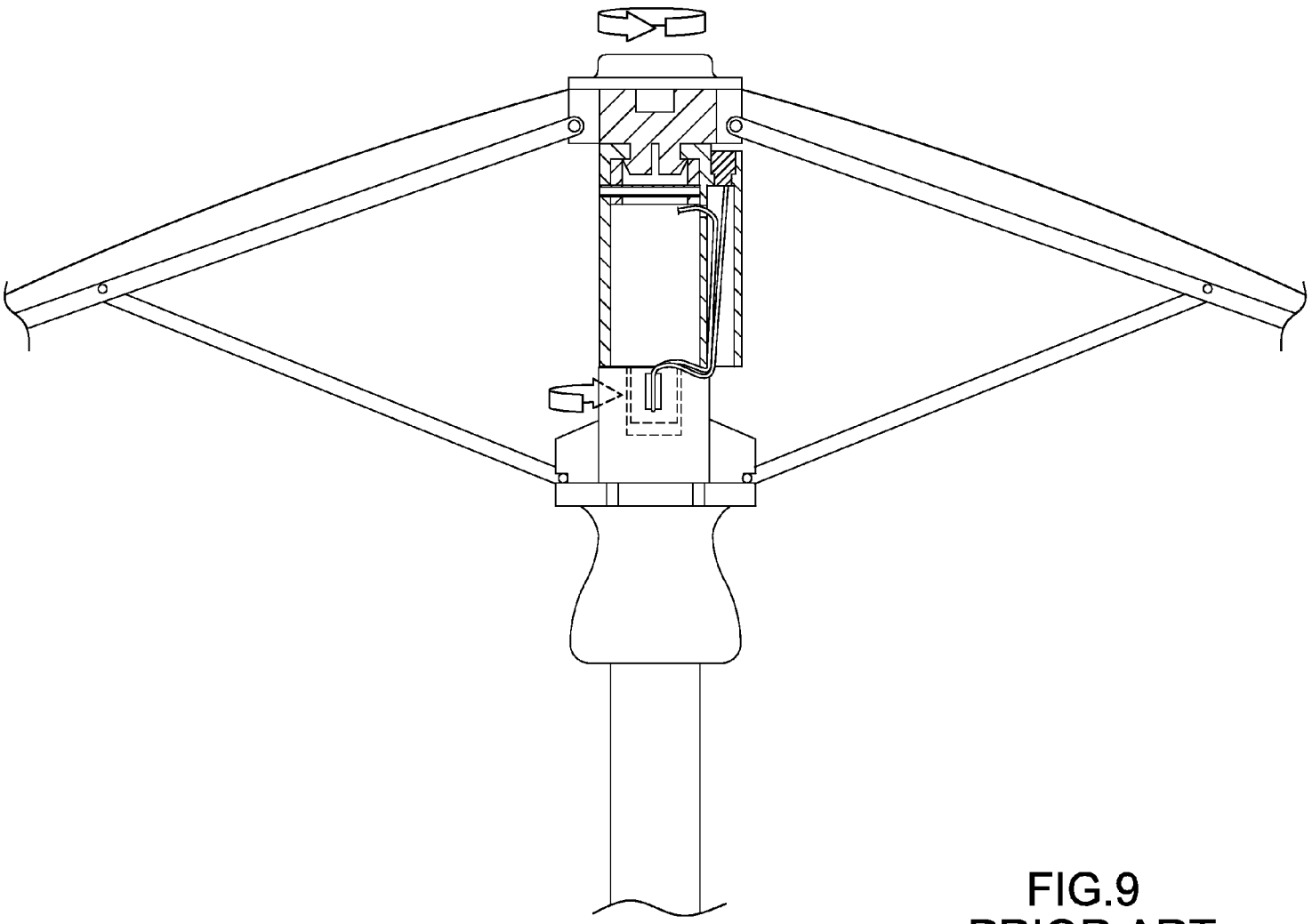
FIG.9 PRIOR ART
FIG. 9 is a schematic view showing a conventional umbrella with a rotatable upper umbrella nest applied to an umbrella.

As shown in FIG. 8, after the umbrella of the invention is opened and used, the movable upper nest 23 and the movable lower nest 33 can be rotated relatively to the central shaft 1. Thus, even when the canopy unit 4 encounters the strong wind, or the distal end of the rib 41 encounters an external force impact by the artificially collision, the canopy unit 4 can drive the movable upper nest 23 and the movable lower nest 33 to synchronously rotate relatively to the central shaft 1. Consequently, the central shaft 1 and rib 41 cannot be easily damaged by the external force, the lifetime of the umbrella can be extended, and it is also possible to prevent the distal end of the rib 41 from stabbing the eye and face of the human body. In addition, it is worth noting that the lower nest body 32 and the pulley seat 31 of the invention are not rotated when the movable lower nest 33 is rotated. So, when the movable lower nest 33 is rotated, the phenomena that the drawstring 7 is tied and the rotation stops can be avoided.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. An umbrella with a canopy rotating function, the automatic umbrella comprising:

a central shaft, which is a hollow structure and has an axis extending in a longitudinal direction;

an upper nest assembly, which is fixedly mounted on a top end of the central shaft, and comprises an upper nest body, a fastener and a movable upper nest, wherein the upper nest body is hollow tubular and fit with and connected to the central shaft, two ends of the upper nest body have a first pivot portion and a first engagement portion, respectively, the fastener is combined with the upper nest body, two ends of the fastener have a second pivot portion and a projection, respectively, the second pivot portion and the first pivot portion are correspondingly combined with each other, a first embedding portion is disposed between the projection and the first pivot portion, the movable upper nest has a second embedding portion correspondingly rotatably fitting with the first embedding portion, so that the movable upper nest rotates about the axis and relatively to the central shaft;

a lower nest assembly, which is movably disposed on the central shaft, and comprises a pulley seat, a lower nest body and a movable lower nest, wherein the pulley seat is hollow tubular and has a fitting portion, two ends of the pulley seat have a second engagement portion correspondingly engaging with the first engagement portion, and a first connection portion, respectively, the lower nest body is connected to the pulley seat, and has a second connection portion correspondingly combined with the first connection portion, and the movable lower nest is rotatably fit with the fitting portion, so that the movable lower nest rotates about the axis and relatively to the central shaft; and a canopy unit, which has a plurality of ribs connected between the movable upper nest and the movable lower nest, and a canopy covering over the ribs, wherein in an opened state, the canopy unit links with the movable upper nest and the movable lower nest, so that the movable lower nest and the movable upper nest synchronously rotate relatively to the central shaft.

2. The umbrella according to claim 1, wherein a top edge of the lower nest body has a positioning portion, the movable lower nest has a plurality of positioning holes at positions corresponding to the positioning portion in an equally spaced manner, and when the movable lower nest is rotated, the positioning portion can resiliently and projectingly extend to push against the positioning holes to position the movable lower nest.

3. The umbrella according to claim 2, wherein the positioning portion comprises a slot, a resilient member disposed in the slot, and a positioning ball, which is disposed on a top edge of the resilient member and can push against the positioning holes.

4. The umbrella according to claim 1, wherein an external profile of the central shaft has an octagonal shape, a concave shape, a convex shape or a geometric shape.

5. The umbrella according to claim 4, wherein internal profile of the lower nest body has a structure and a shape corresponding to a structure and a shape of the central shaft, and the lower nest body and the central shaft forms a positioning force for clamping each other, so that the lower nest body is not rotatable.

6. The umbrella according to claim 1, wherein the second embedding portion is a projecting ring, and the first embedding portion is an annular groove, wherein the projecting ring and the annular groove are rotatable and embedded with each other, so that the movable upper nest rotates about the axis and relatively to the central shaft.

7. The umbrella according to claim 1, wherein the first engagement portion and the second engagement portion make the upper nest body and the lower nest body be combined and positioned with each other in the opened state.

8. The umbrella according to claim 1, wherein the first connection portion and the second connection portion are combined with each other using a thread structure or an engagement structure.

9. The umbrella according to claim 1, wherein the upper nest body has a sleeve fitting with the central shaft.

10. The umbrella according to claim 1, wherein the movable lower nest has a collar portion corresponding to the fitting portion to make the movable lower nest be rotatably fit with the fitting portion, so that the movable lower nest rotates about the axis and relatively to the central shaft.

* * * * *